US011566815B2

(12) United States Patent
Martinez Galvan et al.

(10) Patent No.: US 11,566,815 B2
(45) Date of Patent: Jan. 31, 2023

(54) INSTALLATION DEVICE FOR SPLIT AIR-CONDITIONER

(71) Applicant: Electrolux Appliances Aktiebolag, Stockholm (SE)

(72) Inventors: Israel Martinez Galvan, Stockholm (SE); Pedro Zemborain, Stockholm (SE)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/771,456

(22) PCT Filed: Dec. 13, 2017

(86) PCT No.: PCT/EP2017/082610

§ 371 (c)(1),
(2) Date: Jun. 10, 2020

(87) PCT Pub. No.: WO2019/114943

PCT Pub. Date: Jun. 20, 2019

(65) Prior Publication Data

US 2021/0088251 A1 Mar. 25, 2021

(51) Int. Cl.

| | |
|---|---|
| ***F24F 13/32*** | (2006.01) |
| ***F24F 1/0003*** | (2019.01) |
| *E06B 7/28* | (2006.01) |

(52) U.S. Cl.
CPC ..... *F24F 13/32* (2013.01); *F24F 1/0003* (2013.01); *E06B 7/28* (2013.01); *F24F 2221/20* (2013.01)

(58) Field of Classification Search
CPC ..... F24F 1/027; F24F 13/32; F24F 1/0003; F24F 2221/20; E06B 7/28
See application file for complete search history.

(56) References Cited

U.S. PATENT DOCUMENTS

| | | | | |
|---|---|---|---|---|
| 399,491 | A * | 3/1889 | Bukawietis | A47L 3/02 182/62 |
| 1,954,017 | A | 4/1934 | Manning | |
| 2,234,753 | A | 3/1941 | Frazer | |
| 2,268,451 | A | 12/1941 | Hull | |
| 2,320,436 | A * | 6/1943 | Hull | F24F 1/0003 62/262 |

(Continued)

FOREIGN PATENT DOCUMENTS

| | | |
|---|---|---|
| CN | 2190590 Y | 3/1995 |
| CN | 2413205 Y | 1/2001 |

(Continued)

OTHER PUBLICATIONS

Chinese Office Action for Chinese Application No. 201780097456.6, dated Jan. 6, 2021, with translation, 19 pages.

(Continued)

*Primary Examiner* — Eret C McNichols
(74) *Attorney, Agent, or Firm* — RatnerPrestia

(57) ABSTRACT

An installation device configured to hold a window mounted split air-conditioner. The installation device comprises a support structure configured to be mounted on the window sill, and a mechanism for guiding the outdoor unit from a position inside the window opening to a position outside the window opening, and holding the outdoor unit in that position for use.

10 Claims, 15 Drawing Sheets

(56) References Cited

U.S. PATENT DOCUMENTS 2,436,713 A * 2/1948 Cody ..... F24F 13/32 454/204
2,568,968 A * 9/1951 Perrin ..... E04G 3/18 248/236
2,608,148 A * 8/1952 Shapiro ..... F24F 13/32 454/204
2,708,833 A 5/1955 Nigro
2,814,244 A * 11/1957 Hord ..... F24F 1/04 454/203
2,818,793 A * 1/1958 Hord ..... F24F 1/04 454/203
2,925,026 A * 2/1960 Schuster ..... F24F 1/04 454/203
2,935,284 A * 5/1960 Reeves ..... E04G 3/18 248/208
3,030,873 A * 4/1962 Metcalfe ..... F24F 1/04 454/204
3,134,319 A * 5/1964 Marsteller ..... F24F 13/20 454/203
3,476,033 A * 11/1969 Appel ..... F24F 13/20 454/203
3,481,264 A * 12/1969 Ulich ..... F24F 1/04 454/203
3,491,549 A * 1/1970 Oglesby ..... F24F 13/00 62/262
3,552,470 A * 1/1971 Metcalfe ..... F24F 1/04 160/26
3,554,476 A * 1/1971 Gaylor, Jr. ..... F24F 13/32 248/208
3,698,208 A 10/1972 Navara
3,698,308 A 10/1972 Navaro
3,911,803 A * 10/1975 Kong ..... E06B 7/03 454/203
4,086,886 A 5/1978 Edmaier et al.
4,152,844 A 5/1979 Materniak et al.
4,203,302 A 5/1980 Lapeyre
4,334,461 A 6/1982 Ferguson et al.
5,027,614 A * 7/1991 Mori ..... F24F 13/32 62/262
5,167,131 A 12/1992 Karkhanis
5,290,343 A 3/1994 Morita et al.
5,365,992 A * 11/1994 Swain ..... F24F 13/32 160/84.01
5,582,025 A * 12/1996 Dubin ..... F24F 1/0003 248/544
5,823,289 A * 10/1998 Csomos ..... E04G 3/18 182/61
5,979,172 A 11/1999 Teller
5,979,533 A * 11/1999 Dupuie ..... F24F 1/0003 160/240
6,173,930 B1 1/2001 Arbucci
6,257,013 B1 * 7/2001 Murray ..... B60H 1/3229 62/302
6,416,570 B2 7/2002 Goto et al.
6,568,201 B1 5/2003 Cur et al.
6,767,278 B1 * 7/2004 Peterson ..... F24F 1/027 248/200.1
6,983,621 B2 1/2006 Cur et al.
7,121,105 B1 * 10/2006 Rais ..... F24F 1/0003 62/262
7,296,424 B2 * 11/2007 Thompson ..... F24F 1/027 62/115
7,332,019 B2 2/2008 Bias et al.
7,350,759 B1 * 4/2008 Gray ..... F24F 1/027 248/644
7,601,204 B2 10/2009 Woodruff et al.
7,854,141 B1 10/2010 Breen
7,896,957 B2 3/2011 Zhao et al.
7,975,441 B2 * 7/2011 McCarriston ..... F24F 13/32 52/204.5
8,091,844 B1 * 1/2012 Bragg ..... F24F 13/32 248/208
8,104,240 B2 * 1/2012 McCarriston ..... F24F 13/32 52/204.5
8,578,728 B2 11/2013 Cho et al.
8,584,998 B1 * 11/2013 Peterson ..... F24F 13/32 248/208
9,163,854 B2 * 10/2015 Arbucci ..... F24F 13/32
9,179,794 B2 11/2015 Darby
9,303,895 B1 * 4/2016 Grant ..... F24F 1/027
9,447,916 B2 * 9/2016 Darby ..... F16M 13/02
D782,289 S * 3/2017 Darby ..... D8/380
9,605,870 B2 * 3/2017 Darby ..... F16M 13/02
9,909,712 B1 * 3/2018 Darby ..... A47G 7/044
9,938,044 B2 * 4/2018 Gamboa ..... F24F 13/32
9,982,909 B1 * 5/2018 Perez ..... F24F 13/32
10,077,918 B2 9/2018 Darby et al.
10,104,964 B2 10/2018 Darby
10,203,130 B2 2/2019 Gardikis et al.
10,203,180 B2 * 2/2019 Miller ..... F41F 3/0413
10,295,221 B2 * 5/2019 Zhang ..... F24F 13/32
10,359,212 B2 7/2019 Darby
10,401,043 B2 * 9/2019 Li ..... F24F 1/0003
10,408,494 B2 9/2019 Darby
10,520,206 B2 * 12/2019 Xu ..... F24F 13/32
10,775,054 B2 9/2020 Bradford et al.
10,900,689 B2 1/2021 Weiner
2001/0032545 A1 10/2001 Goto et al.
2003/0097854 A1 * 5/2003 Cur ..... F24F 1/027 62/262
2003/0110789 A1 6/2003 Cur et al.
2005/0028545 A1 2/2005 Herbert
2006/0021359 A1 2/2006 Hur et al.
2007/0023592 A1 * 2/2007 Makoso ..... E06B 7/28 248/200.1
2007/0068185 A1 * 3/2007 Thompson ..... F24F 1/027 62/262
2007/0137237 A1 * 6/2007 Rais ..... F24F 1/027 62/262
2008/0053309 A1 3/2008 Woodruff et al.
2008/0104989 A1 5/2008 Movshovitz
2010/0077924 A1 4/2010 Zhao et al.
2010/0197214 A1 8/2010 Geremia, Sr. et al.
2010/0229585 A1 * 9/2010 Bradford ..... F24F 1/34 62/291
2010/0326103 A1 12/2010 Stamm et al.
2012/0137499 A1 * 6/2012 Agnihotri ..... F16M 13/02 29/462
2012/0274188 A1 11/2012 Shiborino
2013/0104581 A1 5/2013 Consoli
2013/0153744 A1 * 6/2013 Jin ..... F24F 13/32 248/670
2013/0327509 A1 12/2013 Michitsuji
2014/0020421 A1 * 1/2014 Gallo ..... F24F 13/32 62/263
2014/0076506 A1 3/2014 Olivas
2014/0090334 A1 * 4/2014 Darby ..... E04G 3/18 52/741.1
2014/0311063 A1 10/2014 McIntyre
2015/0034784 A1 * 2/2015 Darby ..... A47H 27/00 248/236
2015/0097096 A1 * 4/2015 Arbucci ..... E06B 7/28 248/208
2015/0211802 A1 7/2015 Yokozeki et al.
2015/0354838 A1 12/2015 Cur et al.
2016/0033166 A1 2/2016 Herbert
2016/0058189 A1 3/2016 Darby
2016/0097547 A1 4/2016 Selg et al.
2016/0298872 A1 10/2016 Darby et al.
2017/0153041 A1 6/2017 Darby et al.
2017/0159948 A1 6/2017 Darby
2017/0191763 A1 * 7/2017 Xu ..... F24F 1/027
2017/0284683 A1 * 10/2017 Gallo ..... F24F 13/0245
2017/0297768 A1 * 10/2017 Gamboa ..... B65D 85/68
2017/0328596 A1 * 11/2017 Darby ..... F24F 1/027
2018/0023842 A1 * 1/2018 Gardikis, Sr. ..... F24F 13/32 248/674
2018/0180305 A1 6/2018 Zhang
2019/0056143 A1 * 2/2019 Zhang ..... F16M 13/02
2019/0063760 A1 * 2/2019 Li ..... F24F 1/62

(56) References Cited

U.S. PATENT DOCUMENTS

| | | | | |
|---|---|---|---|---|
| 2019/0212032 | A1 | 7/2019 | Galvan | |
| 2020/0124296 | A1* | 4/2020 | Baumann | F24F 13/32 |
| 2020/0248911 | A1* | 8/2020 | Lei | F24F 13/32 |
| 2020/0333021 | A1 | 10/2020 | Galvan | |
| 2020/0363075 | A1 | 11/2020 | Bradford et al. | |
| 2021/0010688 | A1* | 1/2021 | Biasotti | F24F 13/20 |
| 2021/0078118 | A1 | 3/2021 | Li et al. | |
| 2021/0088251 | A1* | 3/2021 | Martinez Galvan | F24F 1/0003 |
| 2021/0180828 | A1* | 6/2021 | Xing | F24F 13/32 |
| 2021/0356146 | A1 | 11/2021 | Zhang et al. | |
| 2021/0404749 | A1 | 12/2021 | Wexler et al. | |

FOREIGN PATENT DOCUMENTS

| | | | | |
|---|---|---|---|---|
| CN | 1338593 | A | 3/2002 | |
| CN | 1445491 | A | 10/2003 | |
| CN | 1595005 | A | 3/2005 | |
| CN | 1727764 | A | 2/2006 | |
| CN | 201104001 | Y | 8/2008 | |
| CN | 201249077 | Y | 6/2009 | |
| CN | 101523120 | A | 9/2009 | |
| CN | 201589348 | U | 9/2010 | |
| CN | 103471223 | A | 12/2013 | |
| CN | 203379993 | U | 1/2014 | |
| CN | 203501389 | U | 3/2014 | |
| CN | 203518172 | U | 4/2014 | |
| CN | 104061632 | A | 9/2014 | |
| CN | 203980467 | U | 12/2014 | |
| CN | 204141751 | U | 2/2015 | |
| CN | 204153874 | U | 2/2015 | |
| CN | 204202053 | U | 3/2015 | |
| CN | 204491248 | U | 7/2015 | |
| CN | 205037425 | U | 2/2016 | |
| CN | 205137735 | U | 4/2016 | |
| CN | 106152315 | A | 11/2016 | |
| CN | 106949559 | A | 7/2017 | |
| CN | 206369283 | U | 8/2017 | |
| CN | 107980091 | A | 5/2018 | |
| CN | 109073269 | A | 12/2018 | |
| DE | 4230604 | A1 | 3/1994 | |
| EP | 0756140 | A2 | 1/1997 | |
| EP | 1248049 | A2 | 10/2002 | |
| EP | 1956307 | A1 | 8/2008 | |
| EP | 2063192 | A1 | 5/2009 | |
| FR | 755472 | A | 11/1933 | |
| GB | 212669 | | 3/1924 | |
| GB | 1239997 | | 7/1971 | |
| GB | 2126695 | A | 3/1984 | |
| JP | 54105838 | A | 8/1979 | |
| JP | 07248128 | A | 9/1995 | |
| JP | 08226745 | A | 9/1996 | |
| JP | 2001239121 | A | 9/2001 | |
| JP | 2002357338 | A | 12/2002 | |
| JP | 2009144984 | A | 7/2009 | |
| JP | 2012132640 | A | 7/2012 | |
| KR | 20070077917 | A | 7/2007 | |
| KR | 20160086637 | A | 7/2016 | |
| KR | 20160111687 | A | 9/2016 | |
| KR | 102187381 | B1 | 12/2020 | |
| KR | 20210077328 | A | 6/2021 | |
| WO | 8800676 | A1 | 1/1988 | |
| WO | 0190657 | A1 | 11/2001 | |
| WO | 2005054751 | A2 | 6/2005 | |
| WO | 2005116530 | A1 | 12/2005 | |
| WO | 2009052372 | A2 | 4/2009 | |
| WO | 2011079371 | A1 | 7/2011 | |
| WO | 2012056164 | A1 | 5/2012 | |
| WO | 2014188526 | A1 | 11/2014 | |
| WO | 2014206846 | A1 | 12/2014 | |
| WO | 2015098157 | A1 | 7/2015 | |
| WO | 2015115929 | A1 | 8/2015 | |
| WO | 2017001914 | A1 | 1/2017 | |
| WO | 2017045909 | A1 | 3/2017 | |
| WO | 2017045934 | A1 | 3/2017 | |
| WO | 2017075658 | A1 | 5/2017 | |
| WO | 2017194092 | A1 | 11/2017 | |
| WO | 2018090114 | A1 | 5/2018 | |
| WO | WO-2020038239 | A1 * | 2/2020 | F24F 13/20 |

OTHER PUBLICATIONS

Chinese Office Action with Search Report for Chinese Application No. 201780097448 1, dated Jan. 12, 2021, 8 pages.
Chinese Office Action with Search Report for Chinese Application No. 201780097449.6, dated Jan. 12, 2021, 8 pages.
International Preliminary Report on Patentability for International Application No. PCT/EP2017/082615, dated Jun. 16, 2020, 7 pages.
International Preliminary Report on Patentability for International Application No. PCT/EP2017/082611, dated Jun. 16, 2020, 7 pages.
International Search Report and Written Opinion for International Application PCT/EP2017/082615, dated Aug. 9, 10 pages.
International Search Report and Written Opinion for International Application PCT/EP2017/082611, dated Aug. 9, 2018, 10 pages.
"Evidence for Common Knowledge," 2014, 6 pages.
Chinese Office Action with Search Report for Chinese Application No. 201780097448.1, dated Jun. 29, 2021, with translation, 14 pages.
International Preliminary Report on Patentability for International Application No. PCT/EP2017/082610, dated Jun. 16, 2020, 5 pages.
International Search Report and Written Opinion for International Application PCT/EP2017/082610, dated Aug. 21, 2018, 7 pages.
Chinese Office Action for Chinese Application No. 201680028498.X, dated Sep. 4, 2019, with translation, 15 pages.
Chinese Office Action for Chinese Application No. 201680085261.5, dated Apr. 14, 2020, 11 pages.
Chinese Office Action for Chinese Application No. 201680085261.5, dated Dec. 11, 2020, with translation, 28 pages.
European Communication pursuant to Article 94(3) for European Application No. 16 721 184.6, dated Oct. 7, 2020, 7 pages.
International Search Report and Written Opinion for International Application No. PCT/IB2016/000949, dated Nov. 2, 2016, 9 pages.
International Search Report and Written Opinion for International Application No. PCT/EP2016/060396, dated Jan. 24, 2017, 9 pages.
International Search Report and Written Opinion for International Application No. PCT/EP2016/070382, dated Dec. 1, 2016, 14 pages.
International Search Report and Written Opinion for International Application No. PCT/EP2016/070702, dated Dec. 9, 2016, 9 pages.
Non Final Office Action for U.S. Appl. No. 16/771,107, dated Feb. 8, 2022, 11 pages.
Chinese Office Action for Chinese Application No. 2016800860880, dated Jan. 26, 2021, with translation, 18 pages.
International Search Report and Written Opinion for International Application No. PCT/EP2016/062022, dated Jan. 23, 2017—9 pages.
Chinese Office Action for Chinese Application No. 2016800860880, dated May 7, 2020, 8 pages.
Non Final Office Action for U.S. Appl. No. 16/771,111, dated Dec. 21, 2021, 41 pages.
Non Final Office Action for U.S. Appl. No. 16/771,111, dated Sep. 8, 2022, 17 pages.
Final Office Action for U.S. Appl. No. 16/771,111, dated Apr. 19, 2022, 30 pages.
Notice of Allowance for U.S. Appl. No. 16/771,107, dated Jul. 20, 2022, 9 pages.

* cited by examiner

INSTALLATION DEVICE FOR SPLIT AIR-CONDITIONER

This application is a U.S. National Phase application of PCT International Application No. PCT/EP2017/082610, filed Dec. 13, 2017, which is incorporated by reference herein.

TECHNICAL FIELD

The invention relates to an air conditioner. In particular the present invention relates to a device for installing a split air-conditioner.

BACKGROUND

Air conditioning is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology. The air-conditioner comprises a compressor, a condenser, an evaporator, and typically also an expansion device.

There are different types of air-conditioners. One type of air-conditioner can be referred to as a split air-conditioner. In a split air conditioner, the condenser and the evaporator are located in two different separated units that are interconnected via pipes to circulate a refrigerant from one unit to the other.

Another type of air-conditioner can be referred to a Packaged Air Conditioner. A Packaged Air Conditioner (AC) can be said to be a type of self-contained system, in which all the cooling cycle components, such as the compressor, condenser, expansion device, evaporator and control system are enclosed in a single package. Among the packaged systems, the most commonly used for residential applications are the Window-type ACs, Packaged Terminal AC's (PTAC), and also Portable AC units.

The Packaged Air Conditioner has the advantages of easy installation, relatively small footprint, flexibility for heating/cooling individual rooms and low cost.

In contrast, Split Air Conditioners comprise at least two factory-made separated assemblies, designed to be used together. In a split system, the outdoor unit is separated by some distance from the indoor one(s) by means of semi rigid pipes which contain the refrigerant (at high pressure) that produces the cooling/heating effect in the system. Among other advantages, split systems can provide high efficiency ratios in a wide range of capacities and working conditions. Additionally, in split AC systems, the compressor, outdoor heat exchanger and outdoor fan can be located further away from the inside space, rather than merely on the other side of the same unit (as in PTACs or window air conditioners), achieving lower indoor noise levels.

When installing an air-conditioner having an outdoor unit, such as a split air conditioner or a similar type of air conditioner, installation is often difficult. There is a constant desire to improve air conditioners. Hence, there exists a need for an improved air conditioner and in particular an improved mechanism for installing air-conditioners.

SUMMARY

It is an object of the present invention to provide an improved air-conditioner and in particular an improved device for installing an air-conditioner.

This object is obtained by a device as set out in the appended claims.

In accordance with the invention an installation device configured to hold a window mounted split air-conditioner is provided. The installation device comprises a support structure configured to be mounted on the window sill. Hereby an easy to install installation device can provide for an easy installation of an outdoor unit of a split type air-conditioner, and there is no need to screw the outdoor unit to the outdoor wall.

In accordance with one embodiment, the installation device comprises an emplacement mechanism attached to the support structure and configured to be attached to an outdoor unit of the split air-conditioner. The emplacement mechanism can be configured to, when in use, move the outdoor unit between a first position in a window opening to a second position on the outside of the window. Hereby placing the outdoor unit in an operational position can be facilitated since the outdoor unit easily can be mounted from inside via the window.

In accordance with one embodiment, the emplacement mechanism comprises a set of articulated elements designed to hold the outdoor unit. Hereby the emplacement mechanism can be implemented in a way that is easy to use and can be easily attached to the outdoor unit.

In accordance with one embodiment, the support structure comprises a clamping element to secure the support structure on the window sill. Hereby the support structure can be easily installed and de-installed without making any permanent markings in the wall where air-conditioner is installed.

In accordance with one embodiment, the support structure comprises passages for at least one connection between the indoor unit and the outdoor unit of the split air-conditioner. Hereby the window can be kept in a closed position and there is no need to provide holes in the wall for connecting the indoor unit to the outdoor unit of a split air-conditioner.

In accordance with one embodiment, the support structure comprises a support element to carry the weight of an indoor unit inside of the space to be conditioned. Hereby, the support unit can be used to carry both the outdoor unit and the indoor unit and there is no need to provide a support structure that is designated for only the indoor unit.

In accordance with one embodiment, the support structure comprises a telescopic profile that can be adjusted to the width of a window opening. Hereby, an easy to use fastening mechanism for securing the support structure on the window sill is obtained. Also, the support structure can be easily adapted to different window sizes.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. For example, an air conditioner can be described herein as a cooling system, but the cooler can equally be a heater if the system is run in a heating mode. Some components can be omitted from different embodiments. Like numbers refer to like elements throughout the description.

As has been realized by the inventor, air-conditioners of a split type are difficult and often expensive to install. It would therefore be advantageous to improve the installation device for an air-conditioner. Advantageously, the air conditioner can also include a self-installation device to facilitate its installation, so that no high skilled or certified labour is needed.

Below a description of an air-conditioner of a split type is given. Parts of the description with reference to FIGS. 1-5 is given for providing a context to better understand the benefits of the installation device in accordance with the present invention.

Figure 1:
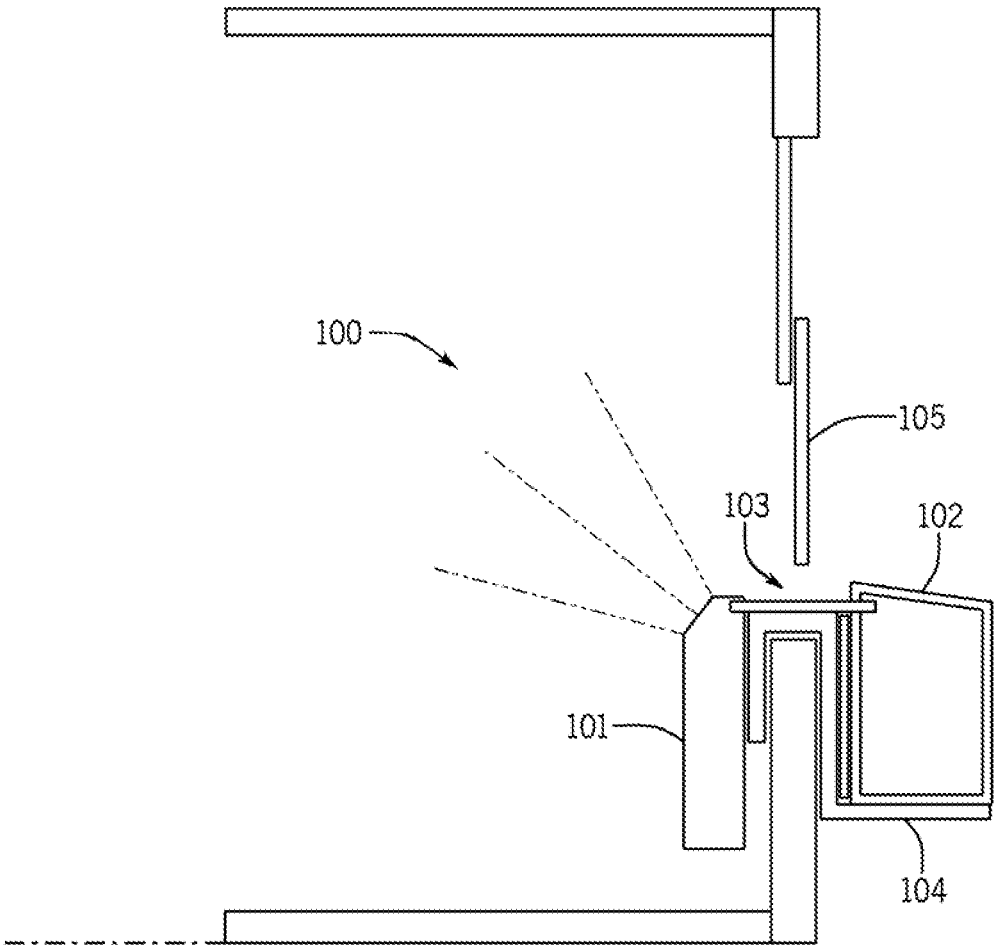
FIG. 1 shows a general view of an AC installation through a window opening.

FIG. 1 shows a schematic diagram of an embodiment of an air-conditioner 100. The air-conditioner 100 can be said to be of a split type comprising an indoor unit 101 and a packaged outdoor cooling unit 102. The units 101, 102 are interconnected via an intermediate connection system 103. Further, an installation device 104 for installation of the air conditioner 100 is depicted. Also depicted is a window 105 where the air-conditioner 100 is installed. In this exemplary embodiment the window 105 is a standard hung type window. The air conditioner can also be installed in other type of windows such as a sliding window or some other openable window. To enable a compact installation of the outdoor unit 102, the outdoor unit can be provided with a fan arrangement that moves air from the top/bottom of the outdoor unit and out via a front air outlet. This makes it possible to install the outdoor unit closer to the outside wall where the outdoor unit is located. Other advantages can also be obtained as is set forth herein.

Figure 2:
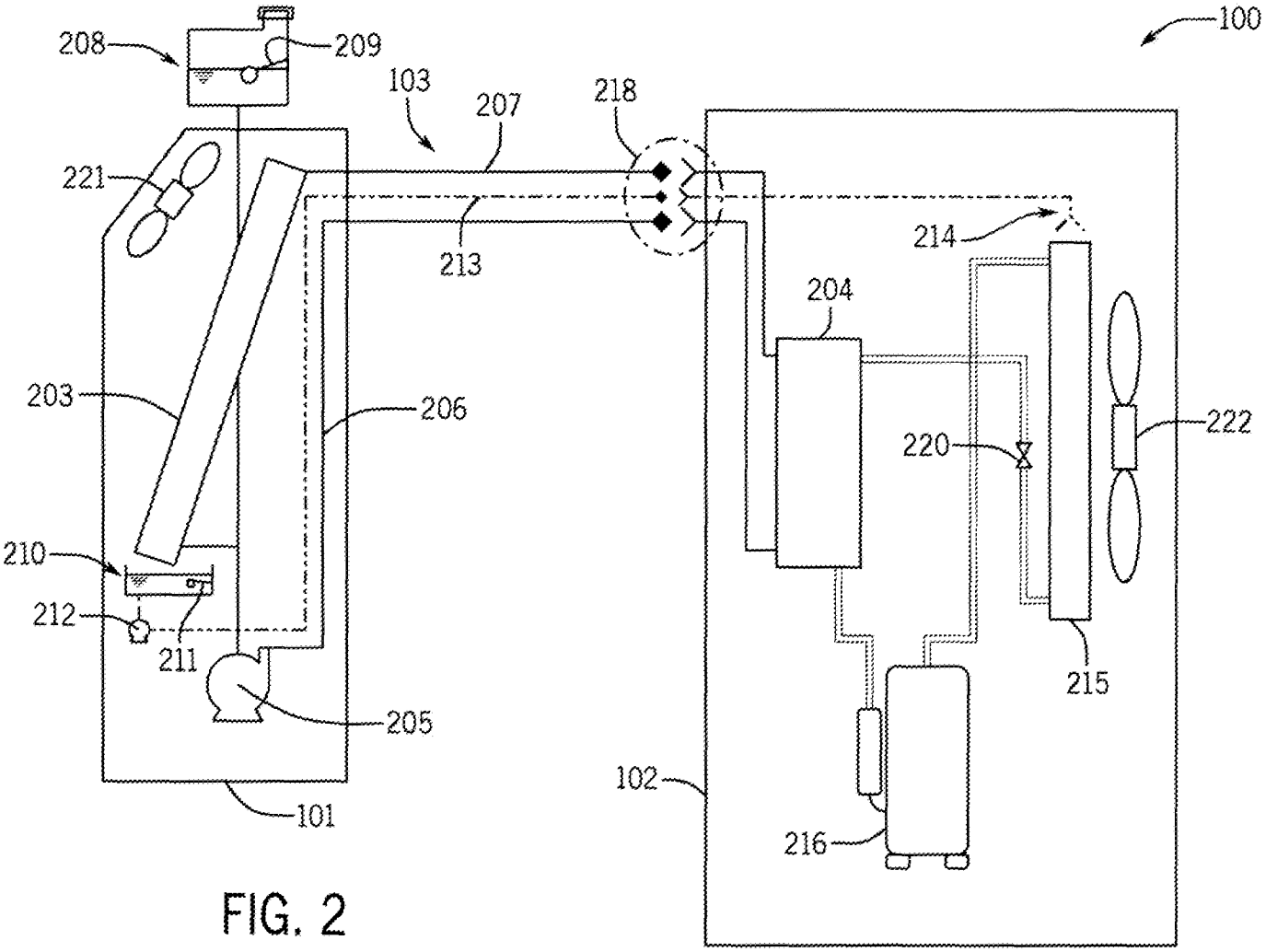
FIG. 2 illustrates a type of a split air conditioner with an outdoor unit.

In FIG. 2, an air-conditioner 100 with an outdoor unit comprising a packaged refrigeration system is described. However, it is to be understood that an outdoor unit not having a packaged refrigeration system also can use the working principles of the fan configuration and other features as set out herein. For example, a conventional split air-conditioner could be provided with an outdoor unit using the technology as described herein. Thus, it is to be understood that the embodiment of FIG. 2 is for illustrational purposes to illustrate an installation.

In FIG. 2, an exemplary implementation of the split type air-conditioner 100 of FIG. 1 is shown in more detail. FIG. 2 shows the indoor unit 101, and the outdoor unit 102. The indoor unit comprises an air-to-liquid heat exchanger 203. The air-to-liquid heat exchanger 203 cools (or heats) the air flowing in the indoor unit 101. Further, a liquid to refrigerant heat exchanger, in particular a compact liquid-to-refrigerant heat exchanger 204 is provided in the outdoor unit 102. The compact liquid-to-refrigerant heat exchanger 204 works as an evaporator. Further a main pump 205 is provided to circulate a liquid solution used as an energy transport media from the indoor unit 101 to the outdoor unit 102 (and back again). This will provide an indirect cooling for cooling of the indoor unit. The main pump can equally be located in the outdoor unit 102. The liquid solution is circulated via the connection system 103. In this example the connection system 103 is formed by two connection pipes 206 and 207. Since, the connection system 103 can be made to work at relatively low pressure (around 1 bar), the pipes 206 and 207 can alternatively be hoses or similar devices that are easy to handle and can be provided with connectors that can withstand a low pressure. The outdoor unit 102 further comprises a refrigeration system, comprising a compressor 216 driving a refrigerant via that an air-cooled heat exchanger 215 via an expansion valve 220 and the compact liquid-to-refrigerant heat exchanger 204 back to the compressor 216. The refrigeration system of the outdoor unit can be factory installed such that the user or installer does not have to work with the circuit circulating the refrigerant. The refrigerant circulated via the air-cooled heat exchanger 215 can then be filled in the factory. There will then be no need to handle a refrigerant during installation, because the refrigerant circuit of the outdoor unit 102 is factory sealed.

Further, a liquid tank 208 can be located on the top of the system. The liquid tank 208 can be connected to the circuit circulating the energy transport media. In accordance with one example the liquid tank can be connected to the suction port of the main pump 205. The tank 208 can include a level sensor 209 for controlling the amount of liquid solution circulated between the indoor unit 101 and the outdoor unit 102 needed for proper operation of the system 100. A box 210 can be provided under the indoor heat exchanger 203 for collecting any condensate that is generated on the indoor heat exchanger 203. A sensor 211 can be provided to detect the water level inside of the condensate box 210. The sensor 211 can generate a signal that can be used to control a condensate water pump 212. When activated the water pump 212 is adapted to pump water from the box 210 to outside of the indoor unit 101. In particular, water can be pumped outside of the building where the indoor unit is mounted to be released on the outside. Hereby an arrangement that can pump condensate water from the indoor unit 101 to the outside is obtained.

In accordance with some embodiments the water is pumped to the outside unit 102. The pumped water can then for example be pumped through a drainage line 213 towards a spray device 214 located on the top of the outdoor air-cooled heat exchanger 215, which is connected to the compressor 216. FIG. 2 further depicts a fan 221 provided in the indoor unit 101 for circulating air in the indoor unit. Also, a fan 222 is provided in the outdoor unit for circulating air in the outdoor unit 102. The connection system 103 can further be provided with a connection device 218. The connection device 218 can for example be a quick connection to in a quick and safe manner interconnect the piping of the indoor unit 101 with the piping of the outdoor unit 102. The connection device 218 can advantageously be located on the top part of the outdoor unit for easy access. By connecting the indoor unit 101 with the outdoor unit 102, an energy transport media can be circulated between the indoor unit 101 and the outdoor unit 102. Also, condensate water can be transported from the indoor unit to the outdoor unit 102 via the connection system 103.

In use, the air conditioner 100 decreases the temperature of the energy transport media using the external packaged AC device of the outdoor unit 102. The cooling effect is produced in the compact heat exchanger 204 located in the refrigeration system of the outdoor-unit 102, allowing in turn a temperature drop of the energy transport media, which is then transported in to the indoor unit 101 via the connection system 103. Then, the energy transport media at lower temperature absorbs the thermal energy from the space to be conditioned, by using the low-pressure air-to-liquid heat exchanger 203 of the indoor unit 101. Heat is then returned from the inside unit 101 to the outside unit 102 by returning the energy transport media to the outside unit when having being heated in the indoor unit 101 that is installed in the indoor space to be conditioned. Because the cooling capacity production is isolated to the refrigeration circuit located in the outdoor unit 102 all heavy and noisy components can be confined to the outside unit and the indoor environment can be close to free of noise. Also, there is very little space required for the indoor unit. Because the connection system 103 used to transfer heat between the indoor unit 101 system can be a low-pressure system it can use an energy transport media that is easy to handle, such as water a water based solution, or some other liquid media such as ethanol.

Thus, in accordance with some embodiments, an aqueous media can be used to transport the energy from the indoor space to be conditioned to the compact evaporator located in the external packaged device. The main pump 205 will ensure the flow of the energy transport media by pumping the aqueous media, and the external cooling unit will reject the heat generated in the process to the ambient outdoor air.

This is made possible since the external, packaged cooling system located in the outdoor unit can comprise all the standard constitutive elements in a refrigeration system, such as compressor, condenser, expansion device, evaporator and control system, and refrigerant.

Figure 3A:
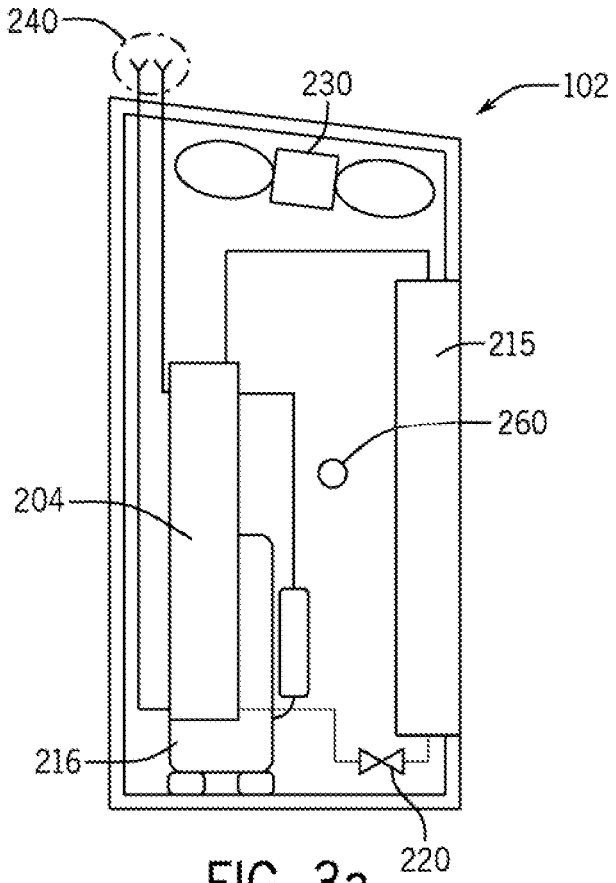
FIGS. 3*a* and 3*b* illustrates location of components in an outdoor unit.
Figure 3B:
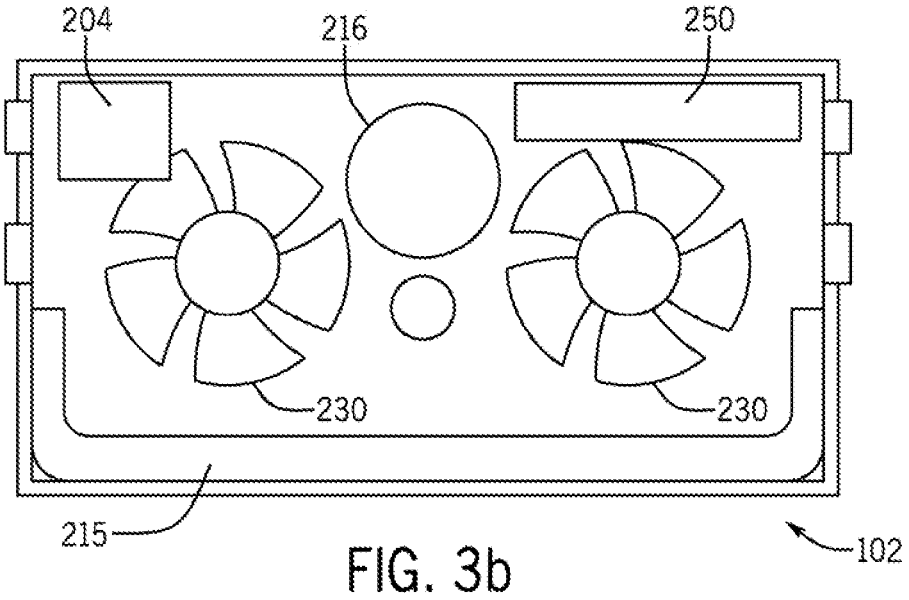

In FIG. 3, an exemplary outdoor unit 102 of a type similar to the embodiment of FIG. 2 is shown. FIG. 3 shows a sectional view from the side to the right and a sectional top view to the right. In FIG. 3, a compressor 216 is provided. In this exemplary embodiment, the compressor drives a refrigerant via that an air-cooled heat exchanger 215 via an expansion valve 220 and a compact refrigerant-to-liquid heat exchanger 204 back to the compressor 216. Further, a fan 230 is provided. In the embodiment the fan 230 is implemented by two axial fans. The outdoor unit 102 can be connected to an indoor unit via the connectors 240. An electronic and control box 250 can be provided to implement the control mechanism of the outdoor unit 102. Also, a free space 260 for air circulation is indicated in FIG. 3. The fan 230 is arranged to move air in the outdoor unit such that air does not have to pass through the back-side of the outdoor unit when the outdoor unit is mounted close to a wall. Hereby it is made possible to mount the outdoor unit very close to or even directly on a wall, since no air has to pass the back-side of the outdoor unit 102. This can make installation easier and also there is less space required for installing the outdoor unit. An additional advantage can be that the load on the arrangement used for securing the outdoor unit can be reduced.

As is seen in FIG. 3 in the left view, the compressor 216 can be located at the back-side of the outdoor-unit 102, i.e. the side facing the wall when the outdoor unit is mounted at a wall. The compressor 216 can also be placed centrally in a sideway direction. Thus, in accordance with one embodiment the compressor is located centrally at the backside of the outdoor unit when the outdoor unit is mounted on a wall.

Further, in accordance with some embodiments, a compact refrigerant-to liquid heat exchanger 204 can be located at the backside of the outdoor-unit. Also, the electronic and control box 250 can be located at the back-side. This makes it possible to locate an air-to-refrigerant heat exchanger 215 and a fan 230 in the remaining space of the outdoor unit allowing air to pass through the air-to-refrigerant heat exchanger 215. Air can be blown through the air-to-refrigerant heat exchanger 215 by the fan 230 from the top-section and/or the bottom section of the outdoor unit 102. The air-to-refrigerant heat exchanger 215 can thus be placed in the interior part the casing, just in front of the rest of components, with a separation between them that creates a free channel where the air can cross the air-to-refrigerant heat exchanger 215 and flow with a low restriction. In accordance with some embodiments, the fan 230 that drive the air flow can be placed on the top of the outdoor unit 102.

Since the compressor 216 is normally the heaviest component of the system, a location thereof at the center-back of the structure, ensures a balanced system with respect to the width of the unit. In a conventional air-conditioner it is often the case that the outdoor unit has a heavier side, which corresponds to the side where the compressor is located. This makes it difficult to transport and install a conventional outdoor unit.

Furthermore, the location of many of the heavy components as exemplified above at the back side of the outdoor unit will provide an outdoor unit 102 with a center of gravity located in the low center-back of the outdoor unit 102. This will provide an equilibrated and steady structure for the outdoor unit 102.

Figure 4A:
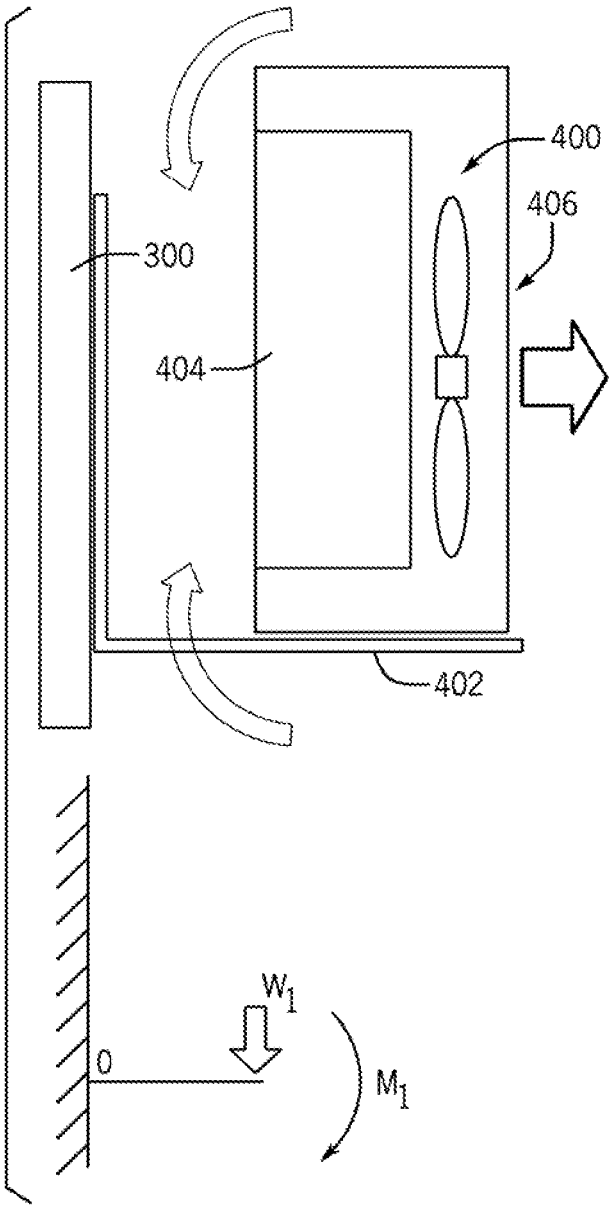
FIGS. 4*a* and 4*b* are comparative views of installations of outdoor units.
Figure 4B:
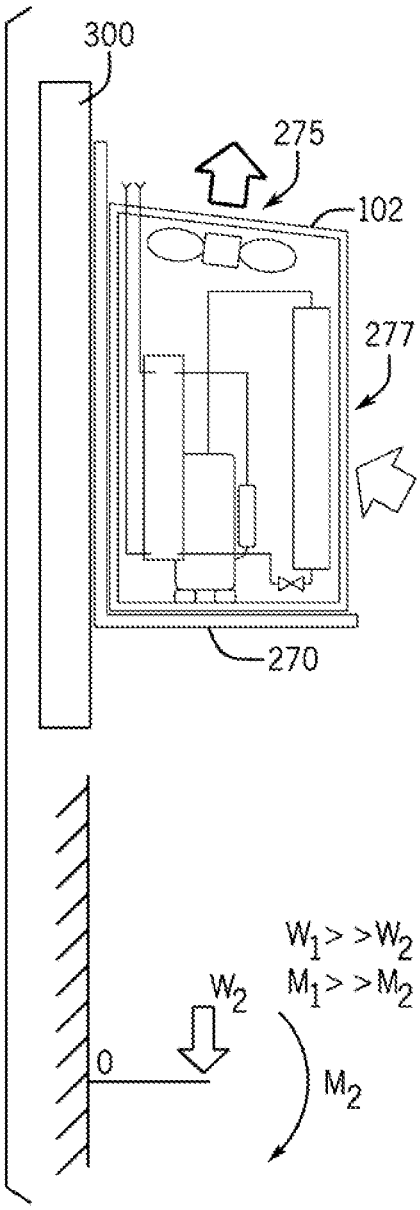

FIG. 4*a* shows the layout of a standard outdoor unit. FIG. 4*b* shows the layout of an outdoor unit in accordance with the above. In FIG. 4*a*, a standard outdoor split AC unit 400 is shown. FIG. 4*a* further shows the structure 402 needed to support the outdoor unit 400. The structure 402 is mounted on a wall 300. The outdoor unit 400 has a backside air intake 404 facing the wall surface. The outdoor unit 400 further has an air exhaust 406 located on the front side of the outdoor unit 400. In FIG. 4*b* an outdoor unit 102 having a fan arrangement in accordance with the above is shown. In FIG. 4*b*, a structure 270 that supports the outdoor unit 102 is provided. The structure 270 is mounted on a wall 300. The outdoor unit 102 has a top side air intake 275. The outdoor unit 102 further has an air outlet 277 intake located on the front side of the outdoor unit 102.

In a configuration as depicted in FIG. 4*a*, a minimum distance between the wall and the air intake area of the outdoor unit 400 is required to ensure its proper operation. A typical minimum distance to the wall 300 is between 15 cm to 30 cm. On the other hand, the layout of the outdoor unit 102 described herein, does not need any separation between the outdoor unit 102 and the wall 300. As a result of that, the weight supported by the structure 270 ($W_2$) and the resulting momentum ($M_2$) is much smaller compared to the corresponding values for the structure 402 of a conventional outdoor unit 400 having to cope with a higher weight ($W_1$) and a higher Momentum ($M_1$).

The air flow path can be configured in accordance with some different alternatives. In FIGS. 5*a*-5*d*, different embodiments that can be used for different configurations are depicted.

Figure 5A:
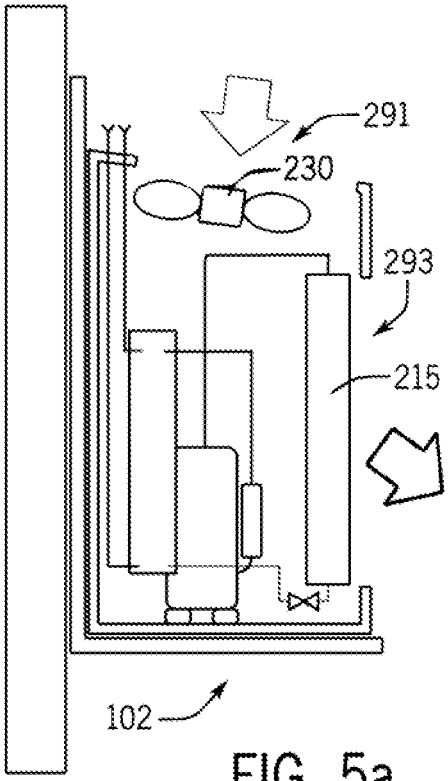
FIGS. 5*a*-5*d* illustrate different fan configuration for moving air in an outdoor unit.
Figure 5B:
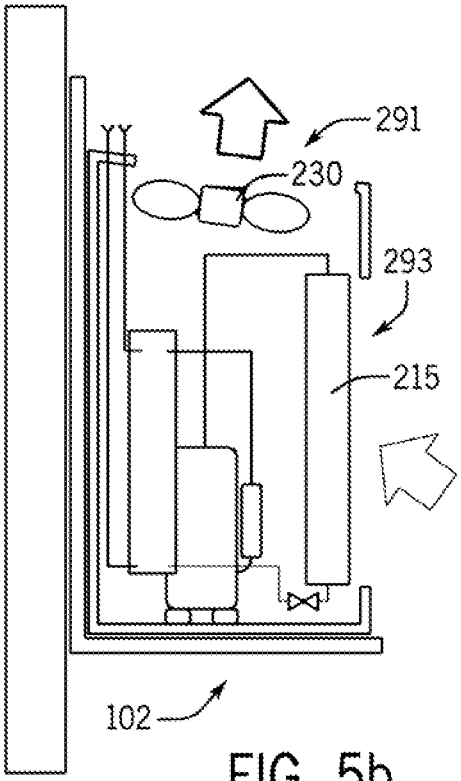

In accordance with the embodiment of FIG. 5*a*, a design where the fan push air and where the fan is located at the top section of the outdoor unit 102 is shown. In such a configuration as is shown in FIG. 5*a*, the air inlet 291 is located at the top of the outdoor unit 102 and air is pushed through the heat exchanger 215 to the air exit the outdoor unit in an outlet 293 in the front of the outdoor unit 102. The fan 230 can also be driven in the reverse direction. The fan 230 will then suck air via the heat exchanger 215 to be blown out at the top section of the outdoor unit 102. Such a configuration is shown in FIG. 5*b*.

Figure 5C:
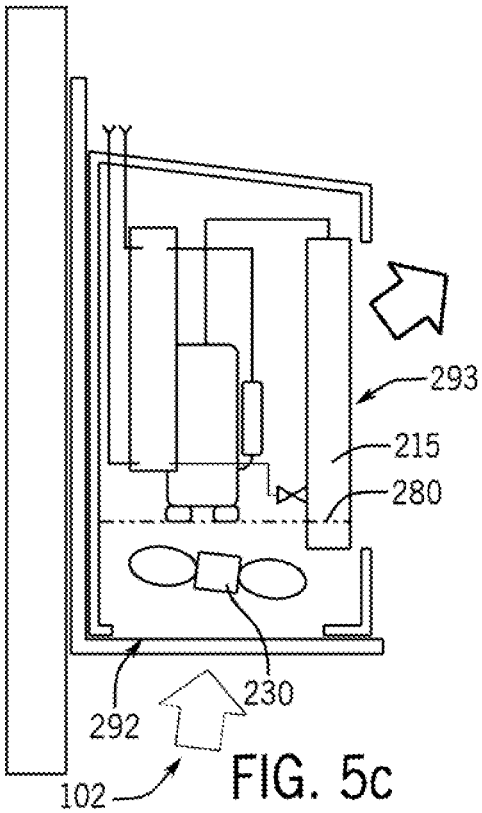
Figure 5D:
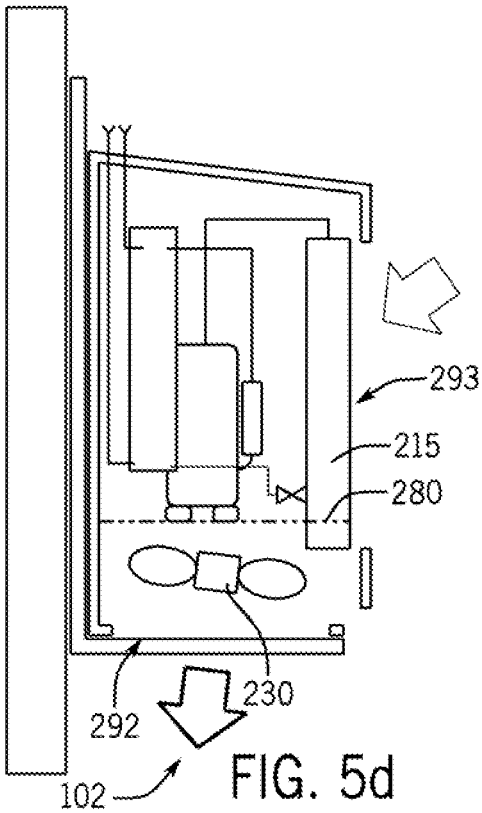

In some embodiments, air can enter/exit the outdoor unit 102 via the bottom section of the outdoor unit. In FIG. 5*c* a design where the components inside the outdoor unit are placed on a grill formed base 280 that allows air to enter from under the outdoor unit. The fan 230 is then located at the bottom section of the outdoor unit 102 to push air from an inlet 292 in the bottom section via the heat exchanger 215 out through an outlet 293 in the front of the outdoor unit 102. The fan at the bottom of the outdoor unit 102 shown in FIG. 5*c* can also be run in the opposite direction to draw air from the front section of the outdoor unit 102 via the heat exchanger 215 out through the bottom of the outdoor unit 102. Such a configuration is shown in FIG. 5*d*. When the outdoor unit is open in the bottom section, the top section can be closed.

In accordance with some embodiments two fans 230 can be used to provide the air flow in the outdoor unit 102. By using two fans, the air flow needed in the heat rejection process can be ensured with a more homogeneous air distribution over the whole heat transfer area of the condenser(s), allowing in turn the use a smaller condenser, due to an improved heat transfer process. In accordance with one embodiment, two fans are mounted on the top of the outdoor unit when mounted on a wall. In an alternative embodiment two fans are mounted at the bottom of the outdoor unit when mounted on a wall. In yet an alternative embodiment fans 230 are located at both the top and the bottom and air enters/exits the outdoor unit 102 both at the top section and the bottom section. In other words, air can be draw via heat the exchanger 215 to exit both at the top and the bottom section or pushed in the opposite direction. In such embodiments fans 230 can be provided both at the top section and the bottom section of the outdoor unit.

To further improve and facilitate installation of an air-conditioner in a window opening, an improved installation device can be provided. Thus, an installation device is designed to assist the installation of an air-conditioner, such as the one described above with an indirect type of cooling through a window opening. However, while an air-conditioner system with indirect cooling is used in this description, the installation device is not limited to such indirect-cooling systems, but any air-conditioner system with an outside unit can be considered. In particular any type of split air-conditioner. In FIG. 1, an installation device 104 that has a support structure configured to be mounted on the window sill is shown. This can make installation easier. Also, the installation device can enable a single support structure to hold both the outdoor unit and the indoor unit as is shown in FIG. 1. This can be obtained by providing holding devices for both the indoor unit and the outdoor unit on the support structure. In particular, an emplacement mechanism can be provided to hold the outdoor unit and a support element can be provided to hold the indoor unit.

An indirect-cooling system could comprise an external packaged outdoor cooling device, an indoor fan-coil unit, and a hydraulic system for transporting an energy transport media between both devices.

In accordance with one embodiment, the installation device 104 comprises a support structure with a clamping element that can be easily fastened over the wall surfaces or over the surfaces of a window frame (internal and/or external). The support structure can be used together with an emplacement mechanism secured to the support mechanism. The emplacement mechanism can be used to move the outdoor unit between a first position in a window opening to a second position on the outside of the window. This can facilitate putting the outdoor unit into place. The emplacement mechanism can comprise a set of articulated elements designed to hold the outdoor unit, such as a packaged cooling outdoor unit, and facilitate its displacement through the window opening to finally place it outside of the space to be conditioned by the installed air-conditioner.

The articulated elements can be equipped with a number of auxiliary components such as springs, gas dampers, hydraulic dampers, gears, pulley systems, or any other, to equilibrate and counteract the weight of the unit in the installation process, so the installer does not have to carry the unit across the window opening where the air-conditioner is to be installed.

The installation device can be configured to allow mounting of electric power wires, control connections, condensate drainage lines, pipes of the hydraulic system, and air systems through the window opening. This can be obtained by providing passages for the different connections between the indoor unit and the outdoor unit of the air-conditioner in the support structure.

Further, the installation device can be provided with a support element like hangers or hooks, located over structure to support the weight of the indoor unit inside of the space to be conditioned. Thus, the profile of the installation device can preferably be such that it allows the closing of the window entirely or almost entirely.

The support structure can be formed in some different ways. For example, in a first exemplary embodiment, the support structure can comprise a telescopic profile that can be adjusted to the width of the window opening. The support structure sits over the window sill, where it can be fastened by elongating the telescopic profile in a transverse direction of the window opening. Additional safety elements can be attached to the support structure to provide additional support over the inner part of the window side jams. Attached to the top side of the support structure having a telescopic profile, an articulated system can be attached to provide a translational and/or rotational movement when installation of the outdoor unit is performed. The articulated system then provides for the emplacement mechanism.

Figure 6A:
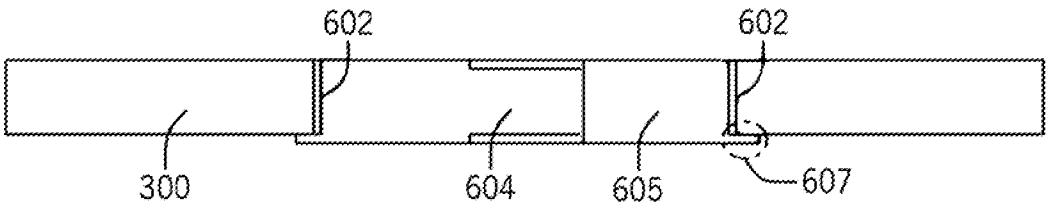
FIGS. 6 and 7 illustrate different support structures and mechanisms for clamping a support structure at a window sill.
Figure 6B:
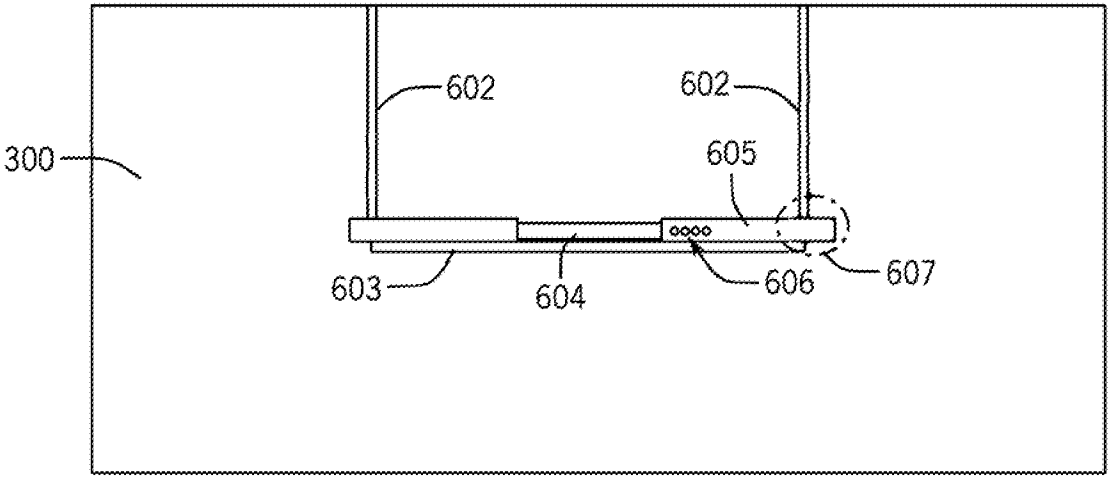
Figure 6C:
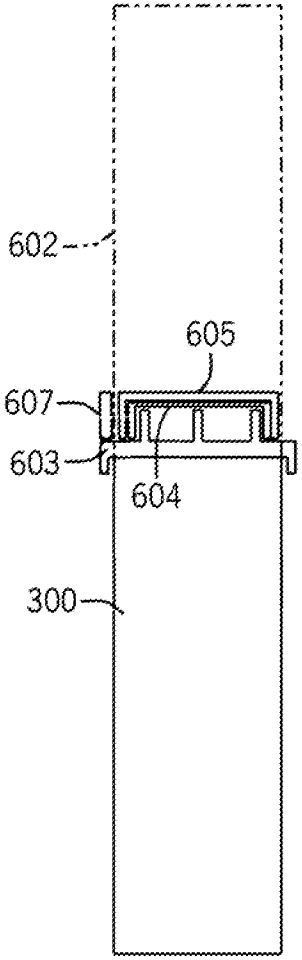
Figure 7A:
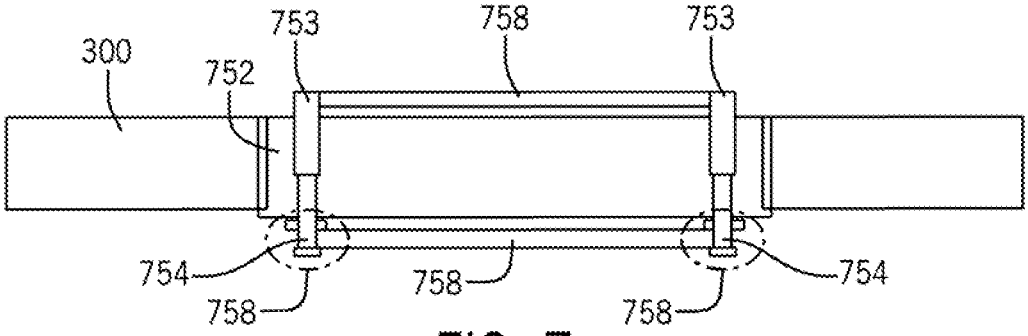
Figure 7B:
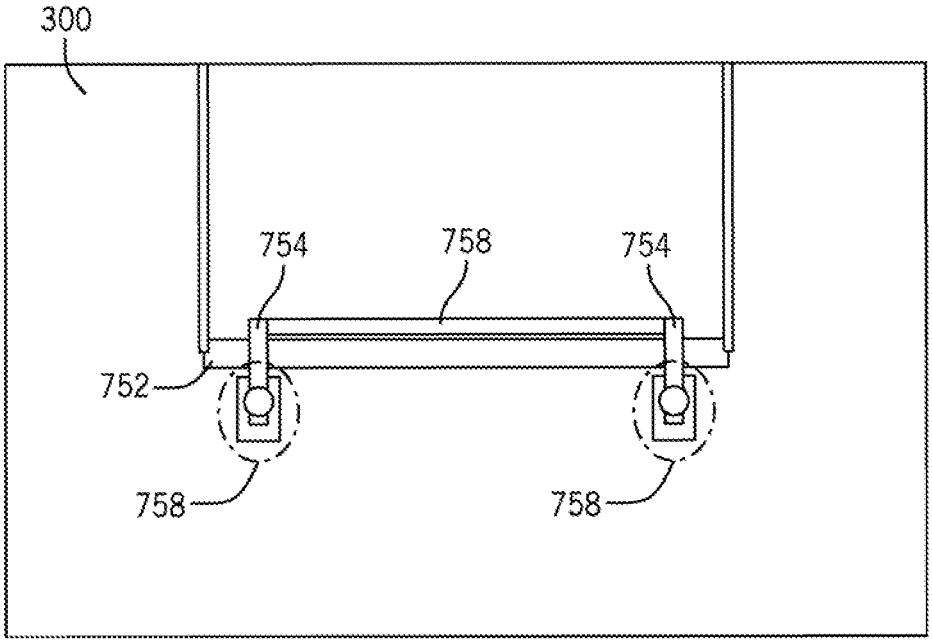
Figure 7E:
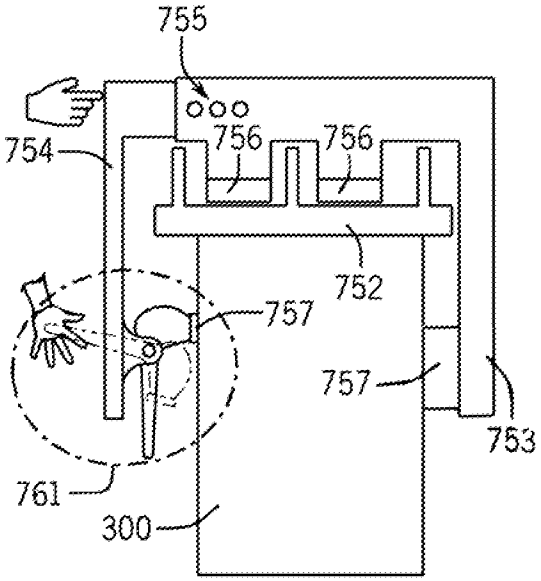
Figure 7D:
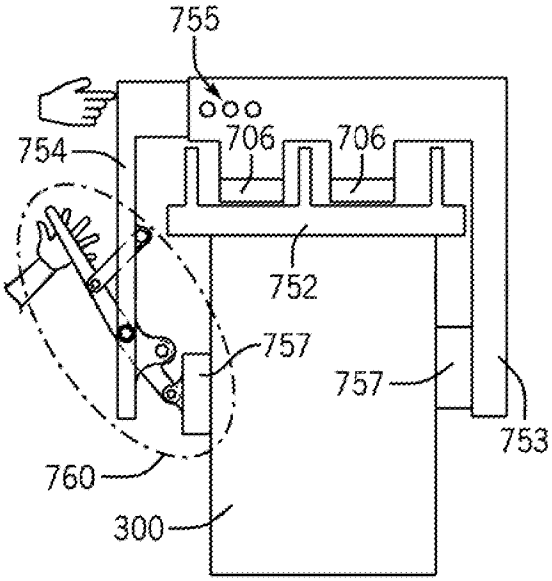
Figure 7C:
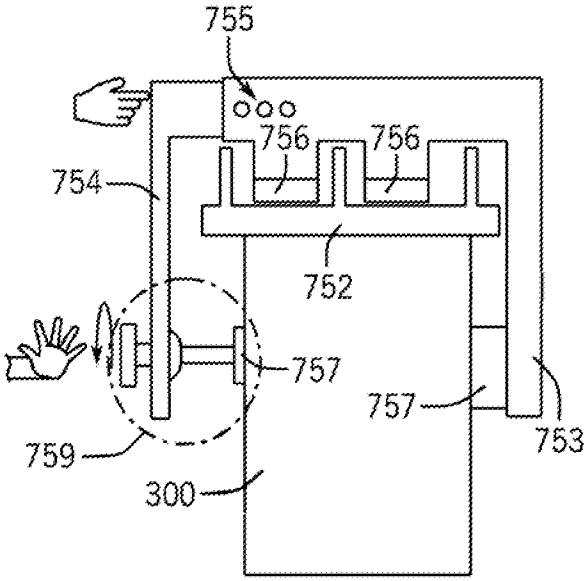

In FIG. 6 an exemplary implementation of an installation device for a window mounted air-conditioner of a split type is shown where the support structure has a telescopic profile forming a clamping element. FIG. 6 shows a top view, a side view and a side view of the installation device. In FIG. 6, a wall 300 with a window is shown. The window has window side jams 602 and a window sill 603. The telescopic profile is formed by, at least, a first part 604 and a second part 605. Further, a lock 606 to lock the telescopic profile in an extended position is provided. Also, safety elements 607 extending from the telescopic profile 604, 605 are shown in FIG. 6. One advantage of using a telescopic profile is that it can be installed in hung-type windows, awning-type but also in hinged-type windows, because the profile of the structure can be hidden in the window frame structure.

In FIG. 7 a second embodiment of a support structure is shown. FIG. 7 shows a top view, a side view and different side views of the installation device. In the embodiment according to FIG. 7, which consist of a sit mechanism to sit over the window sill. The sit mechanism comprises a number of brackets, for example two brackets, that can be attached over the window wall surfaces and window sill to provide the clamping element. In particular, the sit mechanism can be attached without the need of screws, nails, or any other structural fixation method for fixing the sit mechanism to the window sill.

Each bracket comprises two arms that clamp the window wall surfaces to secure the support mechanism on the window sill. In FIG. 7 the wall 300 has a window sill 752. Each bracket has an external arm 753 and an internal arm 754. Further, a safety lock 755 can be provided to lock the arms 753, 754. The sit mechanism can have support elements 756 that face the window sill to support the sit mechanism when resting on the window sill. At least one of the arms 753, 754 such as the outer arm 753 can be provided with gripping material 757 to secure the clamping around the wall 300. Also, connection bars 758 to connect several brackets can be provided.

The side views of FIG. 7 show different ways of tightening the sit mechanism by clamping the sit mechanism to the window wall surfaces. In side view A) a threaded bolt 759 is used to clamp the sit mechanism. In side view B) of FIG. 7 another solution using a 4-bar linked mechanism 760 is shown. Further in side view C) of FIG. 7 a lever mechanism 761 is used to clamp the sit mechanism.

In use, the sit mechanism can hold the weight of an outdoor unit, by distributing the component of the unit's weight into different resulting forces, perpendicular to the wall surfaces. Preferably the sit mechanism is designed to distribute the forces homogeneously over the wall 300. Further the sit mechanism can have a rubber material facing the wall surface. Hereby, the whole system can become static by the action of the friction forces between the wall surfaces and the material of the structure of the sit mechanism. Such a design can offer a static system which keeps the unit weight in equilibrium with the clamping mechanism. The sit mechanism can in accordance with one embodiment comprises in one side, a telescopic and adjustable structure fitting to fit wall/frame thickness.

In addition to a support structure that can be attached to the window frame, a mechanism for easy emplacement of the outdoor unit can be provided. Different mechanisms for putting the outdoor unit in place on the outside of the wall 300 can be used. For example, a folding structure, a rail structure, straps manually handled, articulated arms, an elevation/lowering platform, etc. These mechanisms will be described in more detail below. Regardless of the emplacement mechanism used, it can facilitate putting the outdoor unit in place by letting the user move the outdoor unit from the window opening to its final operational position using the emplacement mechanism. The user therefore does not have to hold the outdoor unit by hand when the outdoor unit is put in its final, operational, position. Instead, the emplacement mechanism can provide for a predetermined path that the outdoor unit can follow. The user then only needs to attach the outdoor unit to the emplacement mechanism, preferably at the window opening. Then the outdoor unit can be pushed into position held by the emplacement mechanism.

Figure 8:
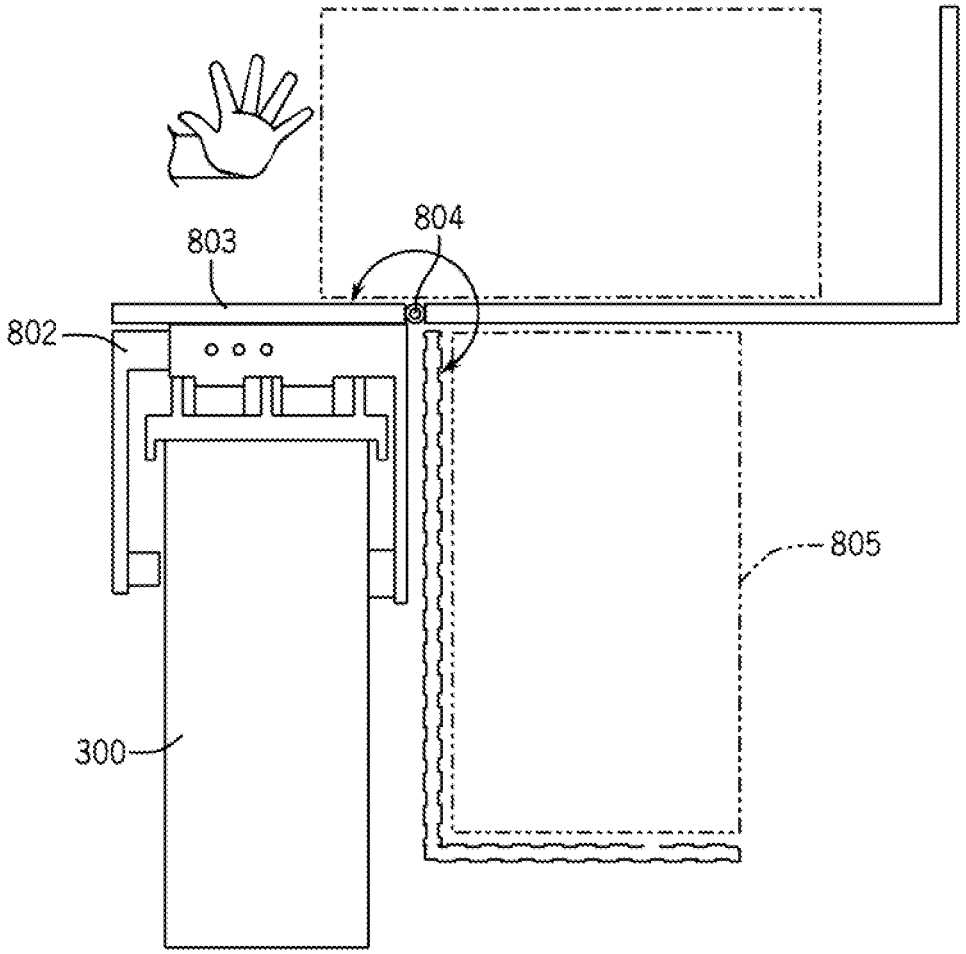
FIGS. 8-11 illustrate different emplacement mechanisms, FIG. 12 illustrate an embodiment of an installation device of a bar-type system, and FIG. 13 illustrate an installation of an air conditioner using an installation device.

In FIG. 8, an exemplary folding mechanism is depicted. In FIG. 8 some support structure, here denoted 802, such as a support structure described above is provided on the wall 300. Further, an articulated mechanism of a folding type 803 is provided on the support structure. The articulated mechanism 803, can have a pivot 804 configured to rotate a holder to download an outdoor unit 805, to its final position outside. Thus, the outdoor unit 905 is moved from a first position at the window opening to a second position where the outdoor unit is installed by letting the outdoor unit rotate down at a pivot.

Figure 9:
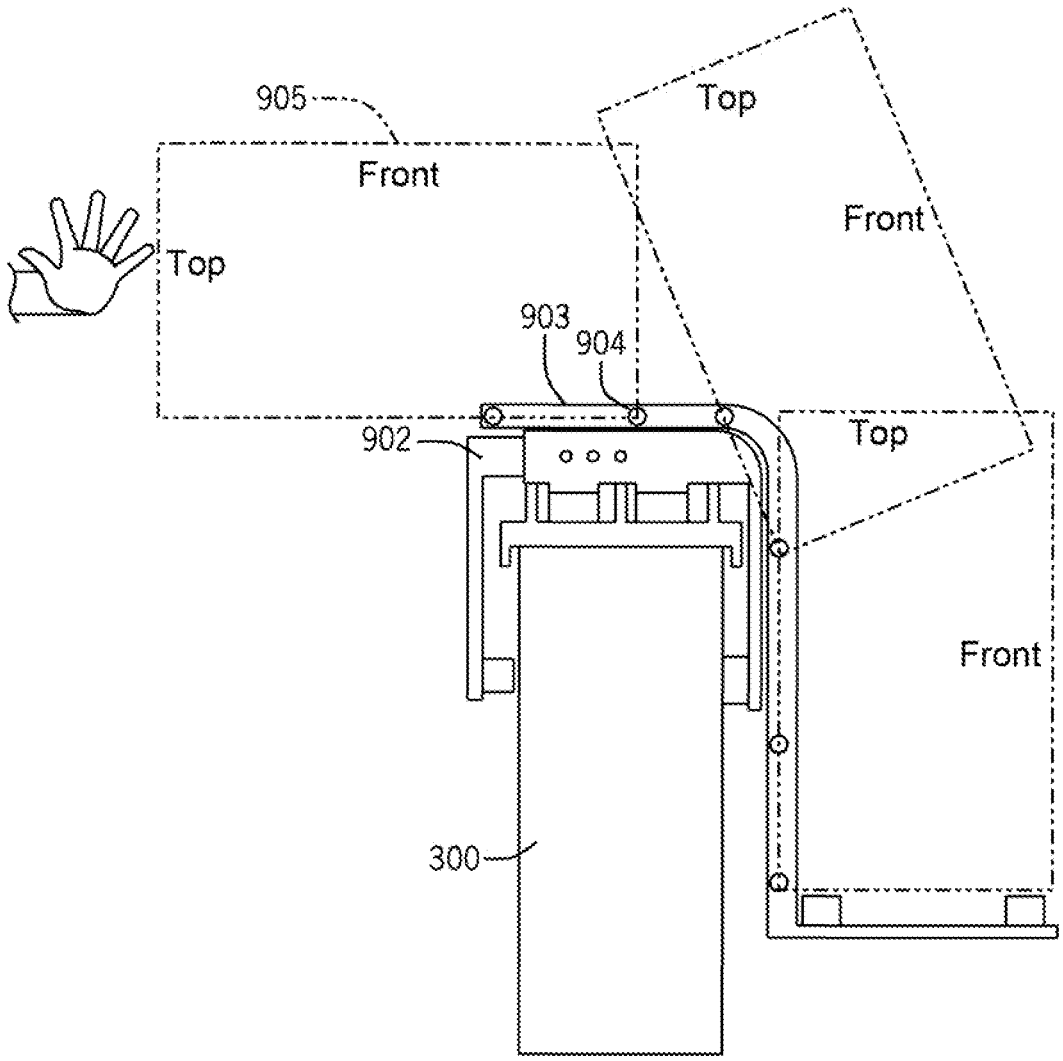

In FIG. 9, an exemplary rail-type mechanism is depicted. In FIG. 9 some support structure, here denoted 902, such as a support structure described above is provided on the wall 300. In FIG. 9 a rail-type mechanism 903 that guides the outdoor unit is shown. The rail-type mechanism 903 can be formed by rails on which guiding elements 904 such as wheels that roll in the rail structure are provided. In use an outdoor unit 905 can be placed on the rail-type mechanism and moved on the rails of the rail-type mechanism from a loading position that for example can be in the window opening to a final position outside on the outside of the wall 300.

Figure 10:
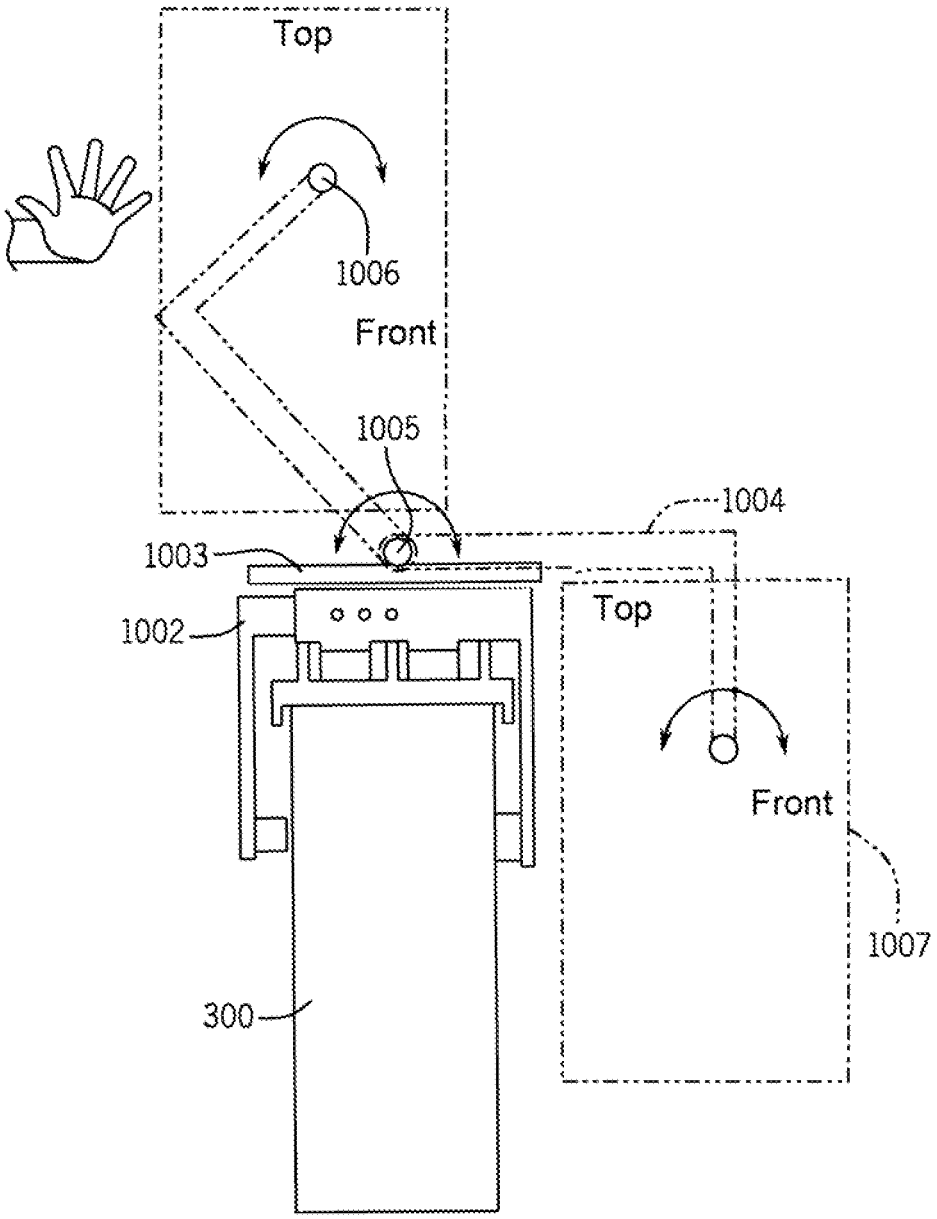

In FIG. 10, another exemplary mechanism is shown for placing the outdoor unit in position. In FIG. 10, an articulated arm(s) mechanism with multiple pivot points is shown. In FIG. 10 some support structure, here denoted 1002, such as a support structure described above is provided on the wall 300. An articulated mechanism 1003 is provided with a central pivot 1005, and pivots 1006 in the far end of articulated arms 1004. The articulated arms 1006 are configured to hold an outdoor unit 1007. Thus, the outdoor unit 1007 is moved from a first position at the window opening to a second position where the outdoor unit is installed by letting the outdoor unit rotate down at the central pivot while attached to the articulated arm(s).

Figure 11:
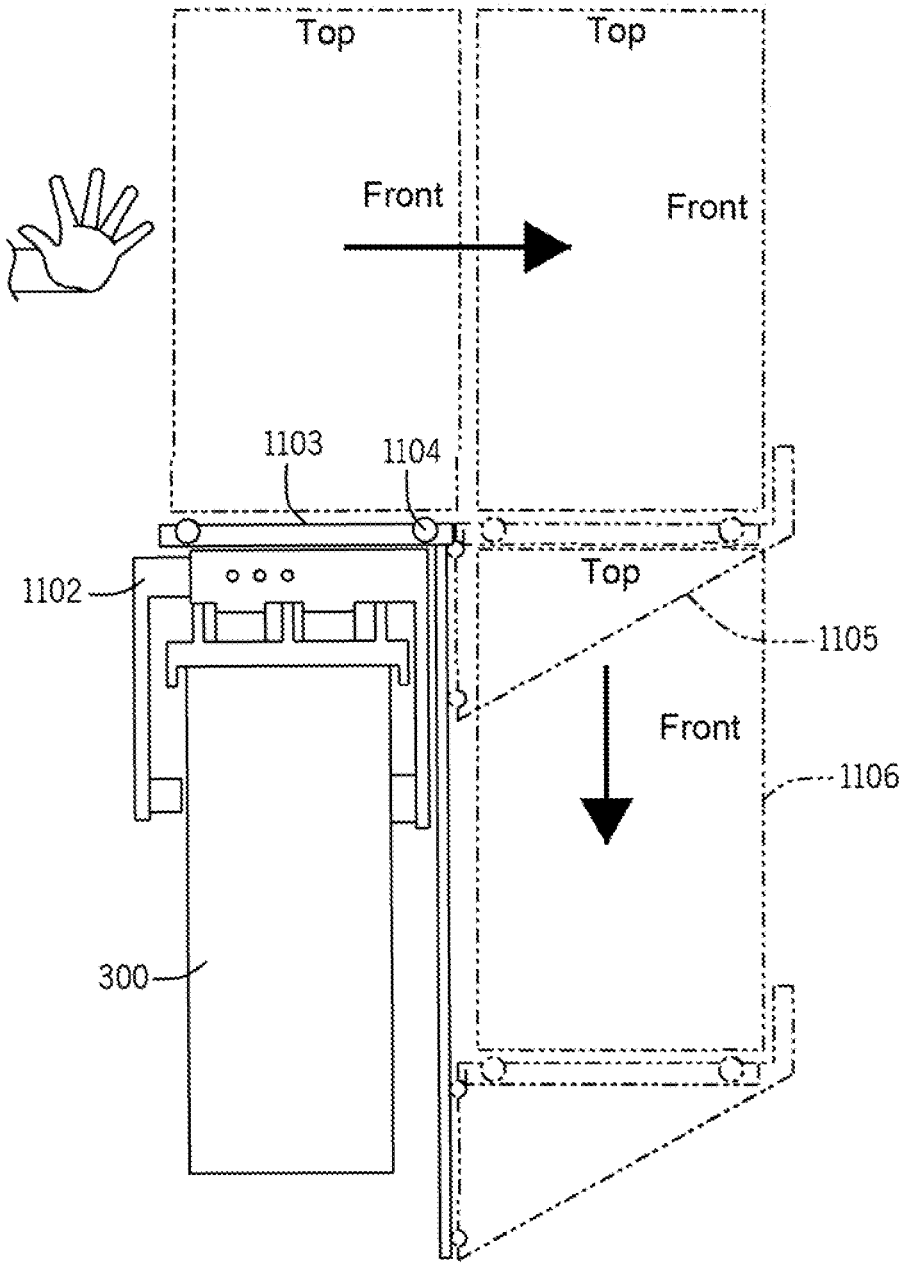
Figure 12A:
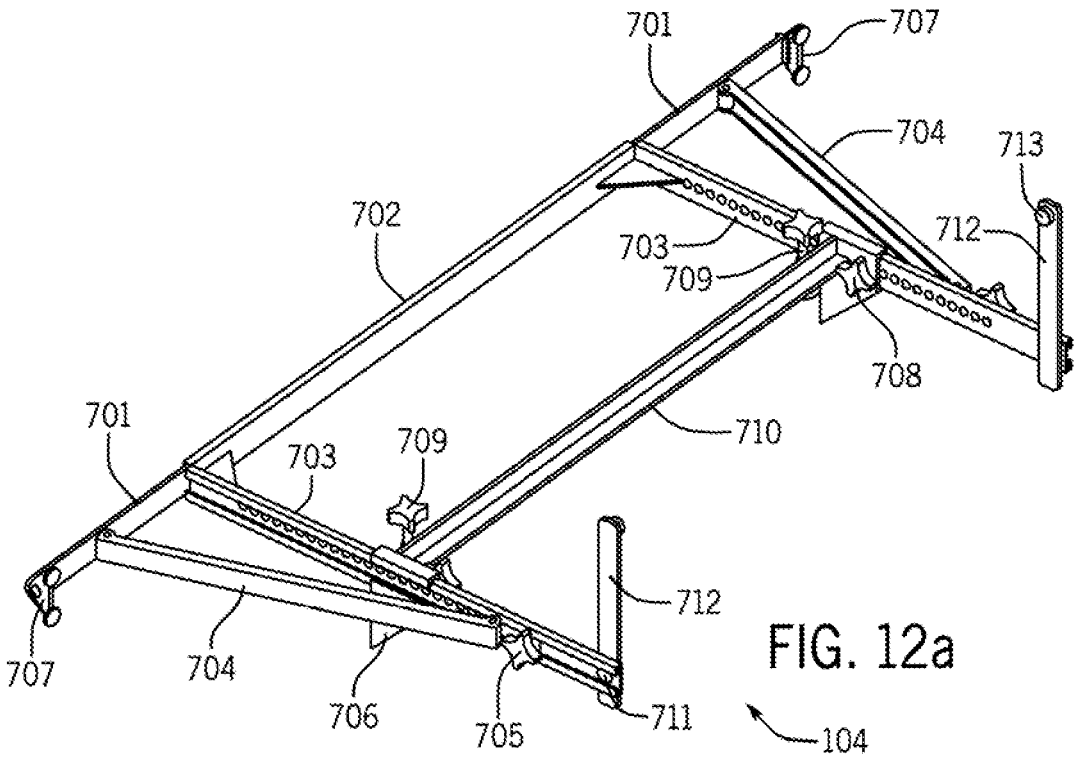
Figure 12B:
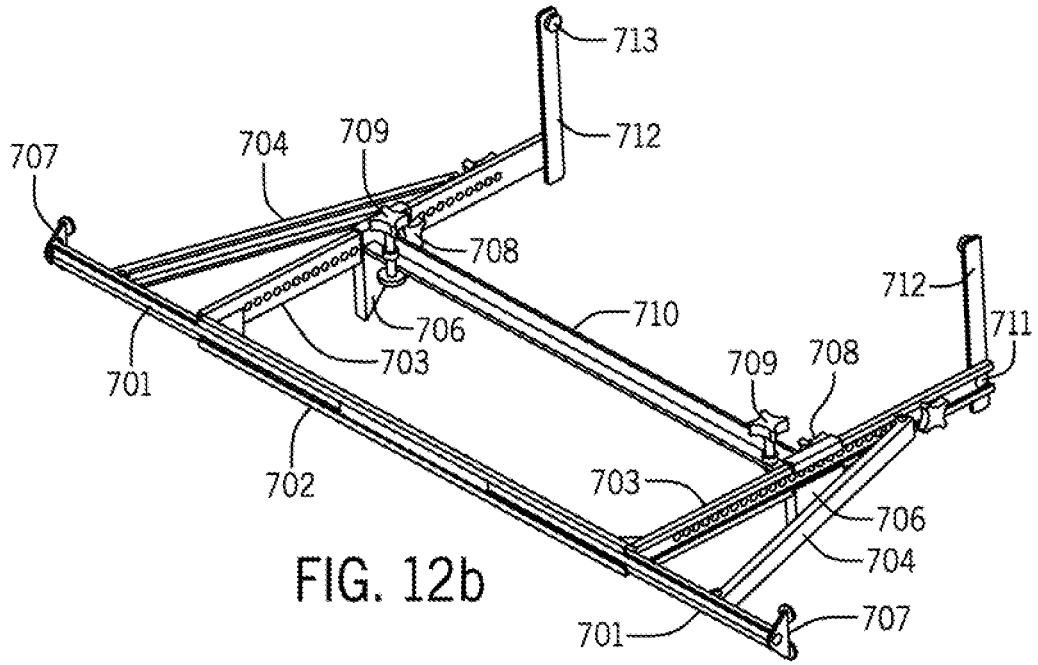
Figure 12C:
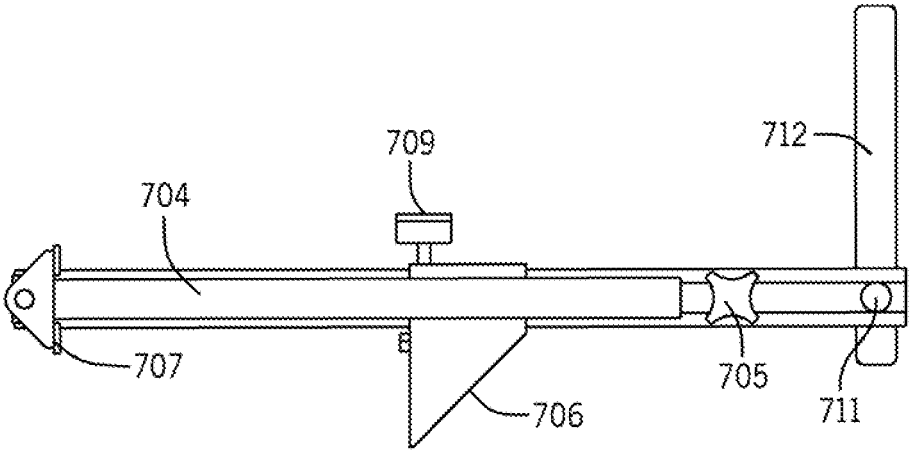
Figure 12D:
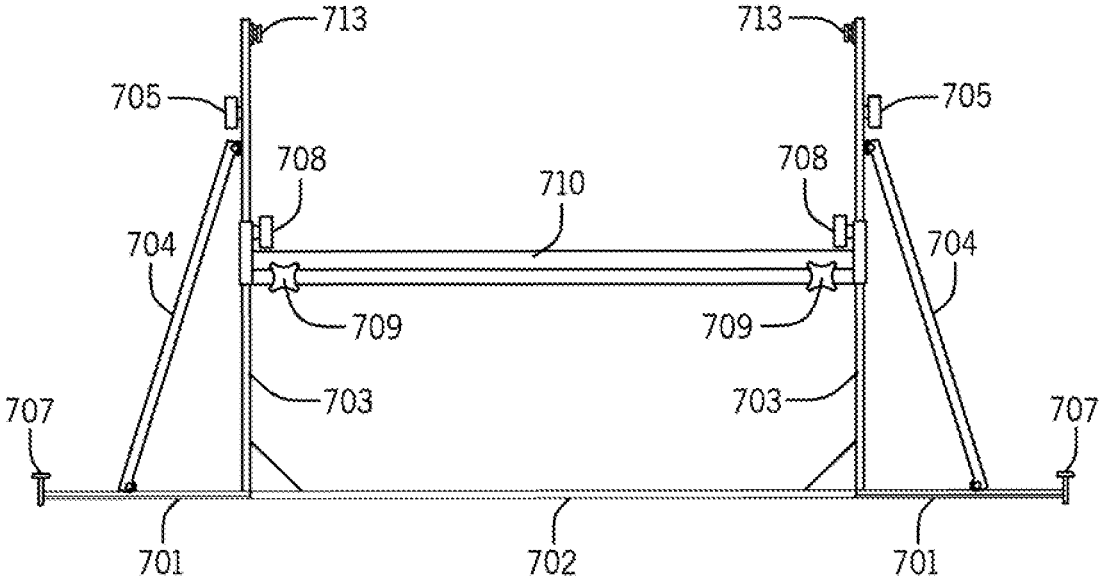

In FIG. 11, yet another exemplary mechanism is shown for placing the outdoor unit in position. In FIG. 11, an elevation/lowering platform mechanism is shown. In FIG. 11 some support structure, here denoted 1102, such as a support structure described above is provided on the wall 300. An elevation/lowering platform mechanism 1103 is provided. The platform mechanism 1103 can comprise several guiding wheels 1104 that are configured to support and transport an outdoor unit 1106 in a horizontal direction until the unit reaches a lowering mechanism 1105. In use—the guiding wheels can be used to move the outdoor unit from the window opening in a horizontal direction and the lowering mechanism can be used to lower the outdoor unit 1106 to a final position outdoors.

In accordance with one embodiment depicted in FIG. 12, an installation device 104 designed as a bar-type system with a clamping device can be provided. FIG. 12 shows the bar-type system in different isometric views and in a side view and in a top view. In such an embodiment, the support structure can comprise a bar with a length longer than the width of the window frame in which the installation device is to be installed. This bar is advantageously capable to hold the total weight of the outdoor unit to be used in the installation. The bar can have different structural elements (support points), which rest over the inner surface of the side jambs of the window frame, but can also rest over the window sill. The bar can also include an emplacement mechanism to facilitate outdoor unit installation through the window opening, from inside of the window. The fixation method can in this structure use the weight of the outdoor unit to keep it steady and integrated to the window frame. Further, a bracket that comprises a self-tightening mechanism can be provided. The self-tightening mechanism can act under different working principles, like screw-type system, a linkages system, lever-type system, or others.

In FIG. 12, an installation device 104 comprising a set of telescopic bars 701 provided to enter into a fixed bar 702 is shown. The length of the bars 701, 702 can be selected according to the size of the window where the outdoor unit will be installed. In FIG. 12 support bars 703 are shown. The support bars 703 are used for providing an articulated mechanism used as an emplacement mechanism. Further some support elements 704 can be used to improve robustness of the support structure, but also limit the relative displacement of the telescopic bar (s) 701. The support elements 704 can be provided to interconnect a support bar with a telescopic bar 701. Also, fixation elements 705 can be used to lock the displacement of the support elements 704.

Further in FIG. 12, clamping elements 706 that are part of the clamping structure can be provided together with stoppers 707. The clamping element 706 and/or the stoppers 707 can be used to clamp the support structure to the window frame to provide a stronger installation. Also, a lock element 708 can be provided to keep the bar system locked tight over the window frame. Also, adjustment bolts 709 can be used to provide support in the vertical plane when the bar system in installed in a window. The adjustment bolts 709 can be located over the window sill, and can be adjusted to regulate the position of the mechanism in the horizontal plane. A displacement bar 710 provided to interconnect the support bars 703 can be used to provide support and rigidity to the system, and to help to moving the clamping elements 706 in parallel. Further, pivots 711 can be used as part of the articulated mechanism. Using the pivots 711, rotating arms 712 can provide a translational and rotational movement to position an outdoor unit in an outdoor position from an initial position in the window opening. Further, linked elements 713 where the outdoor unit is hooked to the installation device can be provided. The linked elements can be provided on the top part of the rotating arms 712.

The installation device as described herein can advantageously be attached to the outdoor unit of the air conditioner by the use of some guiding elements in the casing of the outdoor unit.

Figure 13A:
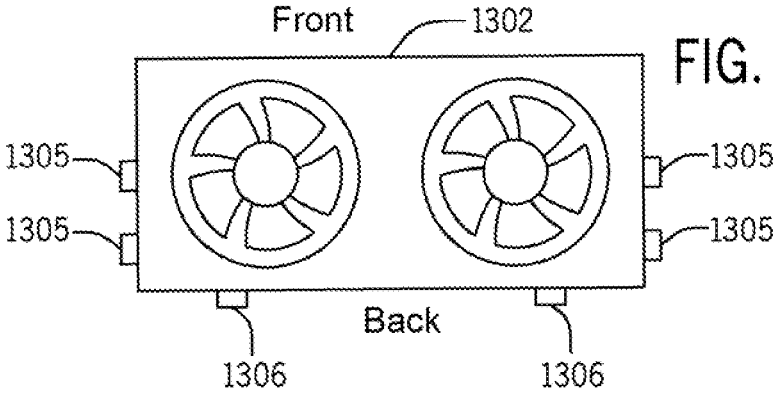
Figure 13B:
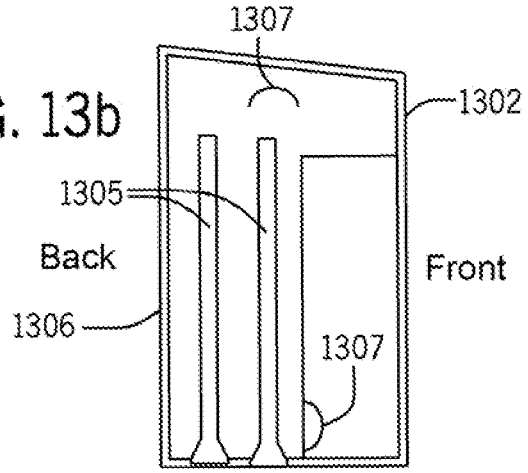
Figure 13C:
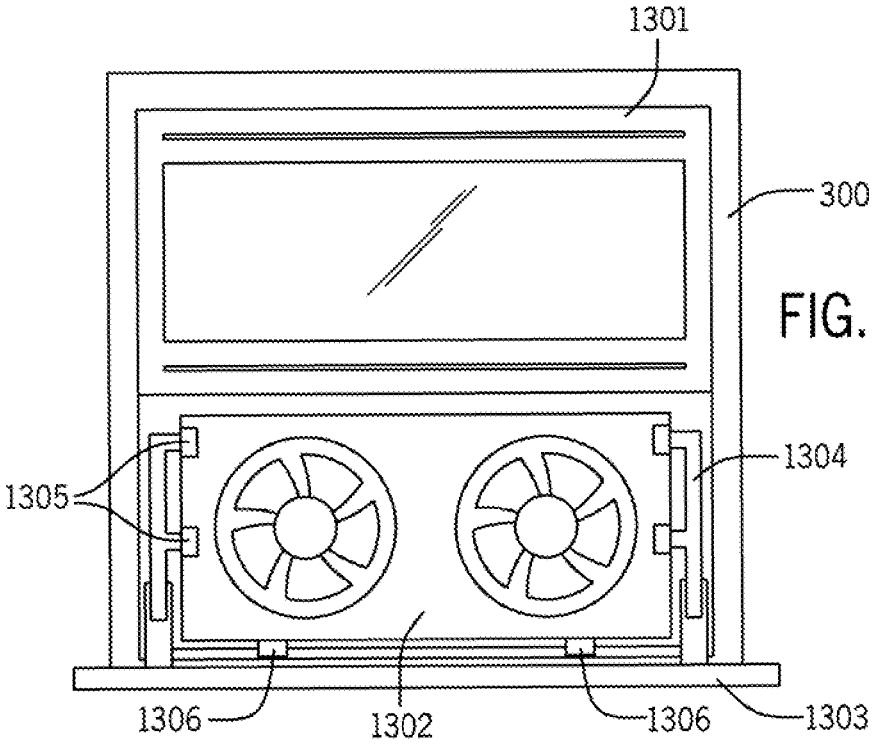

In FIG. 13, an exemplary embodiment of an outdoor unit is shown when installed in a window opening. In FIG. 13, an outdoor unit 1302 is installed in a window 1301. In FIG. 13, a support structure 1303 is shown together with an emplacement mechanism 1304. The emplacement mechanism can for example be an articulated mechanism provided on the support structure. Further linked points 1305 can be provided in the outdoor unit where the articulated mechanism 1304 is attached. This will provide for an easy attachment of the outdoor unit to the emplacement mechanism. To further facilitate installation some guiding elements 1306 can be used to enable sliding of the outdoor unit through the window sill. Also, handles 1307 can be provided on the outdoor unit to facilitate the manipulation of the outdoor unit.

To even further facilitate installation, auxiliary elements can be added to the installation device described herein. For example, springs, or gas dampers can be integrated in the mechanism to equilibrate and counteract the weight of the unit in the installation process. Hereby, a user does not have to carry the unit across the window opening. Such auxiliary elements can be integrated in the body of the outdoor unit or be provided on the structure of the installation device.

Using the installation device as described herein provides an easy to use solution to install an outdoor unit of an air-conditioner. The installation can be made without the use without any tool. The installation device can also hold the indoor unit. The design of the installation device can be adapted to different sizes and types of windows. The installation can allow for a non-permanent installation.

The invention claimed is:

1. An installation device for a split air conditioner having an outdoor unit, the installation device comprising:

a support configured to connect to a window opening, wherein the support comprises a first support bar and a second support bar that is parallel to and spaced in a horizontal direction from the first support bar;

means for guiding the outdoor unit between a first position and a second position;

a first lock element located on the first support bar and configured to clamp against the window opening; and a second lock element located on the second support bar and configured to clamp against the window opening at a second location;

wherein the first lock element comprises a first adjustment bolt configured to support the first support bar in a vertical plane, and the second lock element comprises a second adjustment bolt configured to support the second support bar in the vertical plane.

2. The installation device of claim 1, wherein the support is configured to connect to opposite lateral sides of the window opening.

3. The installation device of claim 2, wherein the support comprises one or more telescoping members, each telescoping member being configured to extend laterally to contact a respective opposite lateral side of the window opening.

4. The installation device of claim 3, further comprising a tightening mechanism configured to tighten the support to the window opening.

5. The installation device of claim 1, wherein the means for guiding comprises one or more arms, each of the one or more arms being rotatably connected to the support by a respective first pivot.

6. The installation device of claim 5, wherein each of the one or more arms is rotatably connected to the outdoor unit by a respective second pivot.

7. The installation device of claim 1, wherein the first lock element is selectively movable along a length of the first support bar, and the second lock element is selectively movable along a length of the second support bar.

8. An installation device for a split air conditioner having an outdoor unit, the installation device comprising:

a support configured to connect to a window opening, wherein the support comprises a first support bar and a second support bar that is parallel to and spaced in a horizontal direction from the first support bar; and means for guiding the outdoor unit between a first position and a second position;

wherein the first support bar is connected to the support at a first location, and the second support bar is connected to the support at a second location, and wherein the installation device further comprises:

a first support element connecting the support to the first support bar, and extending from a first proximal point on the support to a first distal point on the first support bar, wherein the first proximal point and the first distal point are spaced from the first location; and a second support element connecting the support to the second support bar, and extending from a second proximal point on the support to a second distal point on the second support bar, wherein the second proximal point and the second distal point are spaced from the second location.

9. The installation device of claim 8, wherein the support comprises a central member, a first telescoping member configured to extend laterally from one end of the central member, and a second telescoping member configured to extend laterally from another end of the central member.

10. The installation device of claim 9, wherein:

the first location is on the central member;

the second location is on the central member;

the first proximal point is on the first telescoping member; and the second proximal point is on the second telescoping member.

* * * * *